US011497316B1

(12) United States Patent
Habchi

(10) Patent No.: US 11,497,316 B1
(45) Date of Patent: Nov. 15, 2022

(54) HYGIENIC PORTABLE COT

(71) Applicant: Philippe Georges Habchi, Long Beach, CA (US)

(72) Inventor: Philippe Georges Habchi, Long Beach, CA (US)

( * ) Notice: Subject to any disclaimer, the term of this patent is extended or adjusted under 35 U.S.C. 154(b) by 0 days.

(21) Appl. No.: 17/378,221

(22) Filed: Jul. 16, 2021

(51) Int. Cl.
*A47C 17/70* (2006.01)
*A47C 17/82* (2006.01)
*A47C 19/12* (2006.01)

(52) U.S. Cl.
CPC ..... *A47C 17/70* (2013.01); *A47C 17/82* (2013.01); *A47C 19/122* (2013.01); *A47C 19/12* (2013.01)

(58) Field of Classification Search
CPC ..... A47C 17/70; A47C 17/64; A47C 17/645; A47C 17/82; A47C 19/00; A47C 19/005; A47C 19/12; A47C 19/122
USPC ..... 5/111, 110, 112, 114, 174, 200.1, 201, 5/202
See application file for complete search history.

(56) References Cited

U.S. PATENT DOCUMENTS 3,605,140 A * 9/1971 Wanner ..... A47C 17/82 135/96
3,699,594 A * 10/1972 Matthey-Doret ..... A47D 7/002 5/99.1
4,034,518 A * 7/1977 Trecker ..... A47B 91/14 43/109
4,143,434 A * 3/1979 Monot ..... A47D 7/002 5/99.1
4,594,743 A * 6/1986 Owen ..... A47C 27/081 5/112
8,572,776 B2 * 11/2013 Grubb ..... A47C 17/52 5/151
10,376,073 B2 * 8/2019 Grubb ..... A47C 17/54
2008/0276872 A1 * 11/2008 Chern ..... A47C 19/122 119/28.5
2012/0073045 A1 * 3/2012 Grubb ..... A47C 17/52 5/150.1
2016/0058196 A1 * 3/2016 Grubb ..... A47C 17/54 5/159.1
2020/0221879 A1 * 7/2020 Habchi ..... A47C 17/82

FOREIGN PATENT DOCUMENTS

EP 0194398 A2 * 9/1986 ..... A47C 17/64
GB 240085 A * 9/1925 ..... A47C 17/82

* cited by examiner

*Primary Examiner* — Robert G Santos

(57) ABSTRACT

A portable bed system comprising a foldable light tubular frame, a foldable shock absorbing molded hollow polymer body containing apposing edges, a foldable squishy foam mattress; when in a folded configuration for stowing, the bed reduces in size, resists shock and the opposing edges seal preventing liquid, insects or dust from entering through its body into the mattress thus overcoming other temporary portable bed size, durability and hygiene limitations.

4 Claims, 3 Drawing Sheets

HYGIENIC PORTABLE COT

BACKGROUND

Hygienic Portable Cot is the name of the present invention and it relates generally to beds, and more specifically to portable beds and cots.

Existing portable beds exhibit size, durability and most notably hygiene limitations.

Size limitation is attributed to the assembly of the parts that overlap each other; for example, the dimensions of the bed frame, legs, body and mattress traditionally overlap each other in a folded configuration requiring more space.

Durability limitation is caused by the materials and design used in manufacturing; for example, wheels, legs and frames traditionally extend from the bed and are exposed to impact with the possibility of breaking.

Hygiene limitation is caused when portable beds are stored before and after use under beds, under sofas, in closets, in storage rooms, in garages or any other unutilized spaces; for example, traditional portable beds have unprotected mattress that get exposed to dust, liquids or insects over time soiling the mattress.

SUMMARY

The present invention overcomes the above limitations by first, reducing the size of the bed system when placed in a folded configuration; second, becoming more durable by utilizing innovative material and a construct that resist impact when in a folded configuration and third, becoming more hygienic by sealing and preventing liquid, insects and dust from entering into the mattress through the body when the bed system is in a folded configuration and stored.

The bed system and its novelties are presented in all its primary parts "Frame, Body and Mattress" in an assembled and disassembled form. Independent claims list the frame, body and mattress parts and their structure while the dependent claims focus of the functional aspects of the bed system. The parts have multiple features separated by semi colons and the features have multiple sub-features separated by commas. Due to the length of the claims and use of similar words multiple times, it may be helpful to separate each claim into sections at the semi colon. Each claim starts with a high-level description of the featured part, followed by a detail description of the feature part and ends with the result of the part.

DESCRIPTION OF THE DRAWING

The novel features believed characteristic of the embodiments of the present application are set forth in the appended claims. However, the embodiment themselves, as well as a preferred mode of use, and further objectives and advantages thereof, will best be understood by reference to the following detailed description when read in conjunction with the accompanying drawings, wherein:

Figure 1:
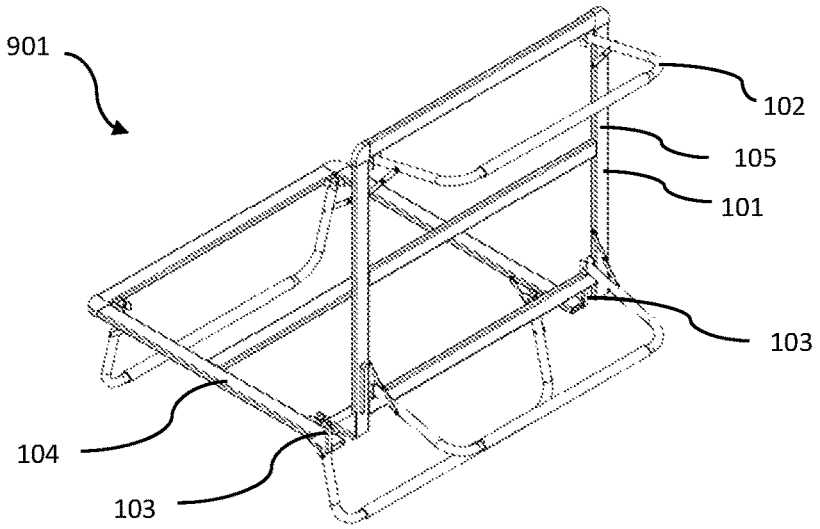
FIG. 1 is a semi folded view of the frame of the bed system.

While the system and method of use of the present application is susceptible to various modifications and alternative forms, specific embodiment thereof have been shown by way of example in the drawings and are herein described in detail. It should be understood, however, that the description herein of specific embodiments not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiment of the system and method of use of the present application are provided below. It will of course be appreciated that in the development of any actual embodiment, numerous implication specific decisions will be made to achieve the developers specific goals, such as compliance with the system related and business related constraints, which will vary from one implementation to another. Moreover, it will be appreciated that such a development effort might be complex and time consuming, but would nevertheless be a routine undertaking for those of ordinary skill in the art having the benefit of this disclosure.

The system and method of use will be understood, both as its structure, function and operation, from the accompanying drawings, taken in conjunction with the accompanying description. Several embodiments off the system are presented herein. It should be understood that the various parts, and features of the different embodiment may be combined together and/or interchanged with one another, all of which are within the scope if the present application, even though not all variations and particular embodiments are shown in the drawings. It should be understood that the mixing and matching of features, elements, and/or functions between various embodiments is expressly contemplated herein so that one of ordinary skill in the art would appreciate from this disclosure that the features, elements and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable other in the art to follow its teachings.

Referring now to the drawings wherein like reference characters identify corresponding or similar elements throughout the several views, FIGS. 1 to 7 depict various embodiments of the bed system 901 and method of use in accordance with a preferred embodiment of the present application. It will be appreciated that the bed system 901 overcomes the above listed problems commonly associated with conventional beds, including portable beds such as foldable mattresses, air mattresses, camping beds and roll away beds. Specifically, bed system 901 is configured to reduce in size, resist impact and prevent dust, insect and liquid from entering through the mattress compartment and into the mattress when the bed system is in a folded configuration and stowed.

Figure 2:
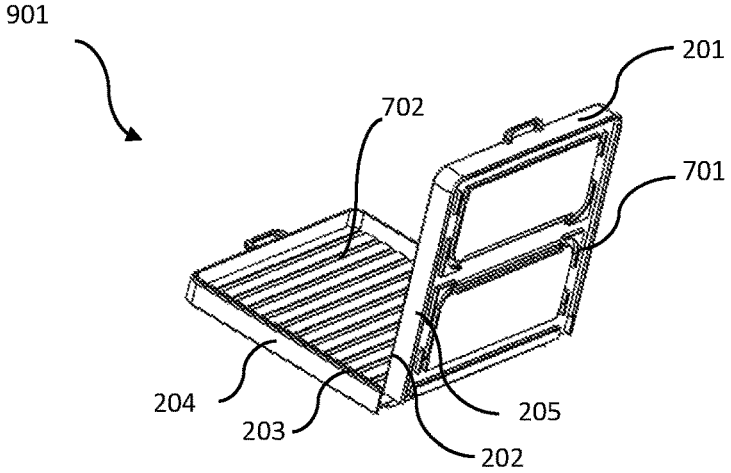
FIG. 2 is a semi folded view of the body of the bed system.
Figure 3:
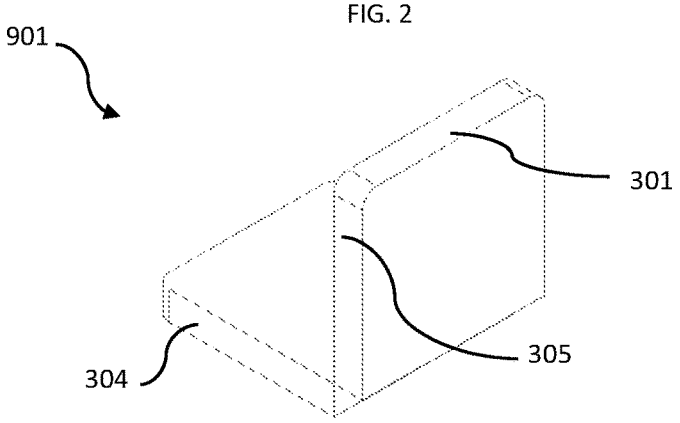
FIG. 3 is a semi folded view of the mattress of the bed system.

Description of the Bed System 901:

Bed system 901 comprising a frame 101 depicted in FIG. 1, a body 201 depicted in FIG. 2 and a mattress 301 depicted in FIG. 3; the frame, body and mattress comprising of two attached sides that fold.

Figure 4:
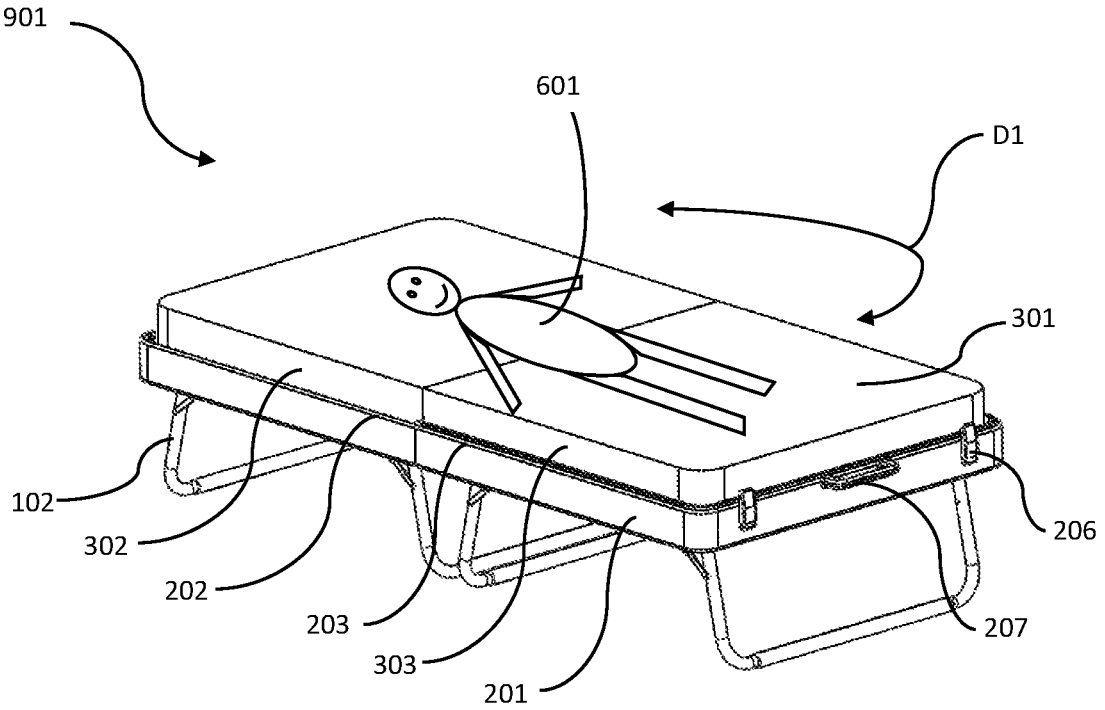
FIG. 4 is an unfolded view of bed system 901.
Figure 5:
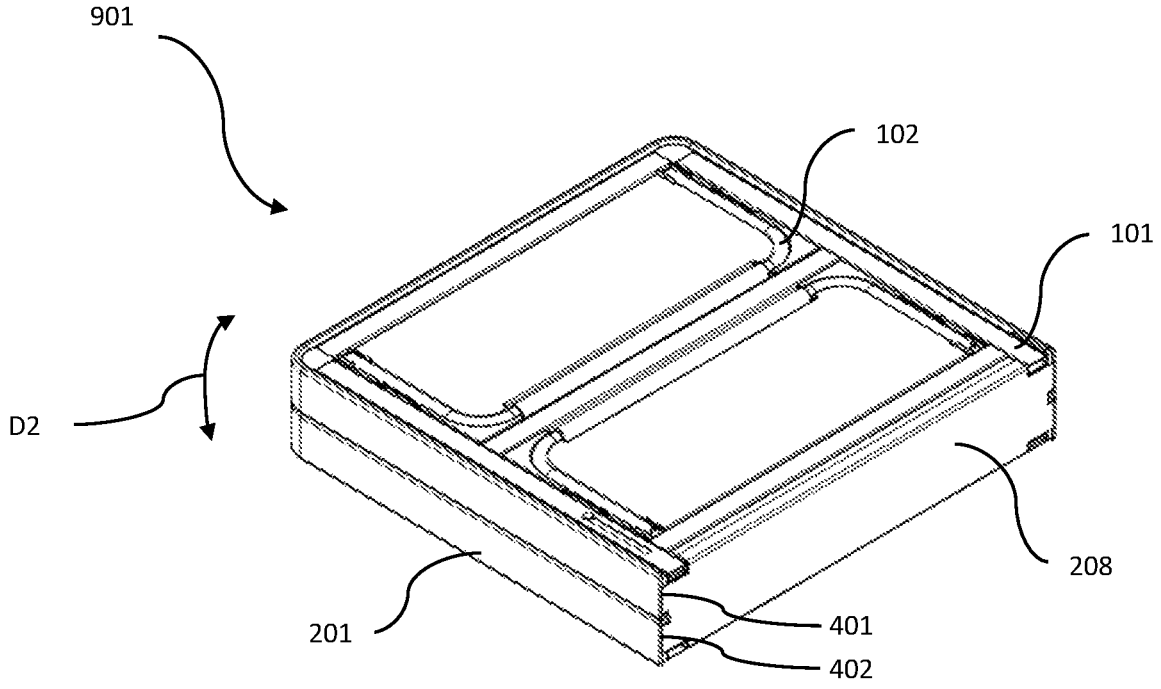
FIG. 5 is a folded view of the bed system 901 a containing a compressed mattress and method in accordance with the preferred.
Figure 6:
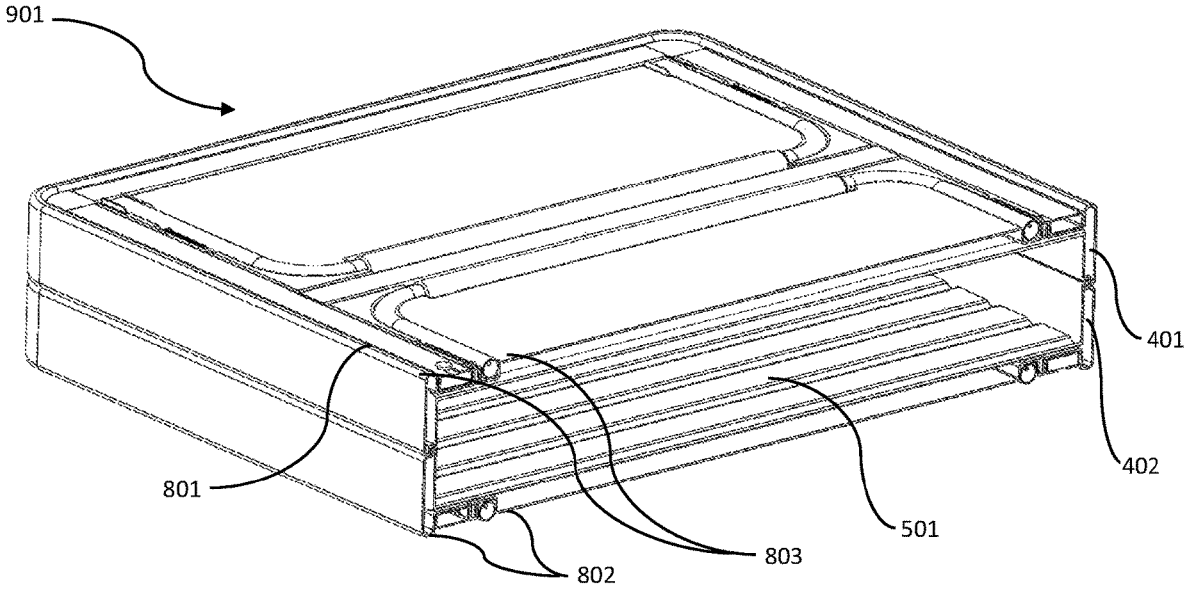
FIG. 6 is a cutout of the folded view of bed system 901 without a mattress and method in accordance with the preferred.
Figure 7:
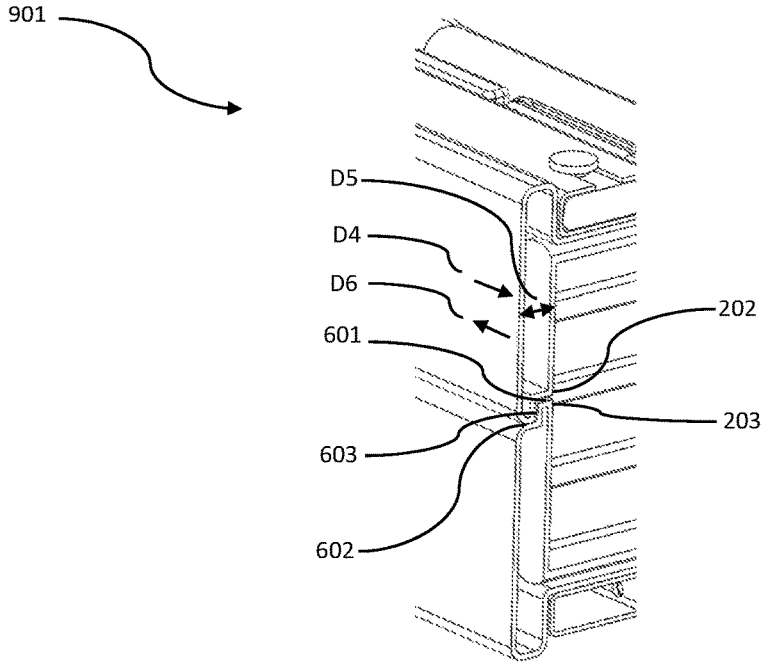
FIG. 7 is a cutout and zoomed in view of the folded bed system 901 without a mattress and method in accordance with the preferred, and embodiment of the present application.

FIG. 4 illustrates an unfolded version of bed system 901. FIG. 5 illustrates a folded and sealed version of bed system 901 containing a mattress (mattress can't be seen as it is fully ingulfed by the body). FIG. 6 illustrates a cutout view of the folded version of bed system 901 not containing a mattress for further clarity and elaboration. FIG. 7 illustrates a cutout and zoomed in view of the folded version of bed system 901 not containing a mattress for further clarity and elaboration.

The bed system is constructed by attaching body 201 to frame 101 via fasteners such as nuts and bolts and attaching mattress 301 to body 201 via fasteners such as hook-and-loop (Velcro), thereafter, a person 601 is able to rest on surface of mattress 301.

FIG. 4, further illustrates the folding process of bed system 901; the folding process is initiated by applying folding force D1 of FIG. 4; the pivoting hinge 103 of FIG. 1 allows for the folding of both sides; upon reaching a semi folded position, force D2 of FIG. 5 is applied to compress mattress 301 within interior hollow mattress compartment 702 of body 201 of FIG. 2 and more closely depicted in 501 of FIG. 6; by engaging locking mechanism 206 of FIG. 4, the bed system can be maintained in a folded configuration and by using handle 207 of FIG. 4 the bed system may become portable.

Description of Frame 101:

Frame 101 comprising two attached sides 104 and 105 FIG. 1; the two sides comprising light hollow and light alloy, a pivoting and attaching mechanism for example a hinge 103 and foldable legs 102, thereby retaining an elevated and unfolded position FIG. 4 supporting body 201, mattress 301, and person 601 or folded position FIG. 5.

Frame 101 attaches to the body 201 with fasteners such as nuts, washers and bolts.

The frame having a protruding male shape respective and corresponding to an aperture female shape located on the exterior of the body of the bed system, the frame attaches to the body in a recessed position 801 FIG. 6 leveled with the outer edges 802 and 803 FIG. 6 of the body. Attaching the frame to the body in a recessed position reduces the overall size of the bed system when in a folded configuration. Attaching the frame to the body in a recessed position also prevents damage from occurring on impact as the frame and all its components are fully engulfed by the shock absorbing polymer body.

Description of Body 201:

Foldable body 201 comprising two attached sides depicted in 204 and 205 FIG. 2; each side comprises of a hollow molded polymer 401 and 402 FIG. 6; the hollow molded polymer is achieved using thermal forming, injection molding, vacuum molding, extrusion molding or blow molding process; the two hollow sides have an interior aperture shape 702 FIG. 2, an exterior aperture shape 701 FIG. 2, a receding edge 202 respective and corresponding to an extending edge 203 FIG. 4 and FIG. 7.

The two interior aperture shaped sides can be depicted by one of the visible sides 702 FIG. 2; in an unfolded configuration, the aperture shaped sides retain the mattress in a recessed position with excess mattress material extending over the edge of the bed 302 and 303 FIG. 4. In a folded configuration, the two aperture sides form a hollow mattress compartment 501 of FIG. 6 and retain the mattress in a sealed structure, FIG. 5 illustrated the mattress being fully enclosed and sealed in the hollow mattress compartment as it is not visible.

The two exterior sides containing aperture shapes 701 FIG. 2 retain frame 101 in a recessed position flush and leveled with the outer edges 802 and 803 FIG. 6 as depicted in 801 FIG. 6 for an overall reduced size of a bed system.

Along the edges of the bed, an extending edge 203 FIGS. 4 and 7 respective and corresponding a receding edge 202 FIGS. 4 and 7 intersect to create a first seal 602, second seal 601 and secondary barrier 603 FIG. 7 when the bed system is in a folded configuration. The seals and secondary barrier convert the clam-shell-like hollow mattress compartment into a sealed cavity preventing matter such as liquid, dust and insects from entering through the hollow mattress compartment into the mattress keeping the mattress dry and clean. For further elaborations, should a lay person attempt to insert a sharp object such as a knife through the intersected opposing, respective and corresponding edges, secondary barrier 603 FIG. 7 will prevent the sharp object from entering the compartment.

Similar to a shock absorber, the walls of each of the hollow body sides 401 and 402 FIG. 6 (Cutout View) are sealed and contain air for an airtight structure 401 and 402 FIG. 5; the airtight configuration produces an elastic effect that acts like a shock absorber designed to resistant impact. When impact force D4 FIG. 7 is applied to the folded bed system, an opposite effect D5 FIG. 7 pushes the wall back D6 FIG. 7 towards to point of impact; the elastic and shock absorbing effect of the hollow airtight body sides combined with the squishy mattress will allow the bed system to be shock resistant when the bed system is in a folded configuration; in an unfolded configuration, the elastic and shock absorbing effect will additionally offer added comfort when combined with the squishy foam mattress.

The hollow polymer molds of the first and second folding sides of the body are airtight and light allowing the bed system to have a portable structure. If the body was made of a solid polymer construct, it would be too heavy to carry around thus losing its portable attributes.

Foldable body 201 contains a locking mechanism 206 for example a latch, a handle 207 as depicted in FIG. 4 and a sealing membrane 208 for example a rubber seal that configured to seal the area of the body that does not contain an extending or receding edge as depicted in FIG. 5.

Foldable body 201 attaches to the frame with fasteners such as nuts, washers and bolts while attaching to the mattress with another type of fasteners such as such as hook-and-loop (Velcro).

Description of Mattress 301:

Foldable mattress 301 is preferably made of soft and squishy material such as polyurethane, latex, memory or hybrid foam that compresses and reduces in size; the body is made of two sides 304 and 305 of FIG. 3 that are held together by an outer skin such as fabric; the mattress folds in half.

Mattress 301 attaches to the body 201 with fasteners such as such as hook-and-loop (Velcro).

When unfolded, mattress 301 contains excess mattress material 302 and 303 FIG. 4 that extends over intersecting extending edges 202 and 203 FIG. 4 of the bed system. Upon folding and placing physical pressure at the closing and locking stage, the mattress has the ability to compress beyond the mattress access material extending over the edge of the bed system. FIG. 5 illustrates mattress 301 is fully contained within body 201 with excess material 302 and 303 compressed and reduced in size to fit within the hollow mattress compartment of body 201 when the bed system is in a folded configuration; the mattress cannot be seen as it is fully enclosed in the sealed hollow mattress compartment. In a folded configuration the bed system will reduce in size due to the mattress having a protruding shape attaching to the body's interior aperture shape in recessed position and compressing to reduce in size to fit within the hollow mattress compartment which has a combined smaller size than the mattress combined size.

SUMMARY OF THE NOVELTIES

As discussed above and illustrated in FIGS. 1 to 7, the bed system resists impact to prevent damage, has components that fold into each other to reduce in size and prevents liquids, dust and insects from entering into the hollow mattress compartment having a superior hygiene structure.

a) Damage prevention occurs through two primary systems. First, the beds polymer material, hollow mold structure, hollow mattress compartment and mattress retained in the hollow mattress compartment comprising an elastic and shock absorbing structure. Second, the exterior body sides retaining the frame in a recessed structure prevents impact of the frame with external objects. The elastic and shock absorbing structure and preventing impact of the frame with external objects prevents damage from occurring to the bed system on impact when in a folding configuration.

b) Size reduction is accomplished in size by attaching the frame to the body exterior in a recessed manner, attaching the mattress to the body interior in a recessed manner and compressing and reducing the mattress and mattress excess material to fit in the hollow mattress compartment when the bed system is in a folded configuration.

c) Superior hygiene is accomplished by its hollow mattress compartment and its extending edge that is respective and corresponding to its receding edges that intersects and seal three out of the four sides of the bed in conjunction with the sealing membrane that seals the side of the bed that does not contain an edge. The sealed hollow mattress compartment and sealing membrane forms an airtight structure preventing liquids, dust and insects from entering through the body into the hollow mattress compartment and mattress when the bed system is in a folded configuration.

Description of the Structures:

Two hollow and airtight structures and three protruding and aperture structures.

The first hollow structure exists within the walls of each of the body halves. The hollow structure is airtight to the degree where it contains compressed air that offers an elastic and spring-like function. It is produced using a thermally formed, blow molded, vacuum molded or injection molded process using polymer. The first hollow structure makes it possible for the bed system to be smaller via its interior and exterior body shapes, stronger via the spring effect compressed air and hygienically inclined via its interior and exterior body shapes in conjunction of the sealing mattress while being light and portable.

The second hollow structure is created by folding and combining the interior sides of the body in conjunction with the sealing membrane located on the side of the be where there is no extending or receding edge. The second hollow structure is designed to retain the mattress in a sealed and airtight configuration. The second hollow structure has shock absorbing characteristics and is airtight to the degree where prevents liquids, dust and insects from entering into the mattress when the bed system is in a folded configuration.

The first protruding structure respective and corresponding to an aperture structure is the frame structure to the exterior of the body structure. The second protruding structure respective and corresponding to an aperture structure is the mattress structure to the interior of the body structure. The third protruding structure respective and corresponding to an aperture structure is the first edge to the second edge of the body that intersect to create an airtight seal preventing liquid, dust and insects from entering through the body into the mattress when the bed system is in a folded configuration.

The particular embodiments disclosed above are illustrative only, as the embodiment may be modified and practiced in different but equivalent manners apparent to those skilled in the art having the benefits of the teachings herein. It is therefore evident that the particular embodiment disclosed above may be altered or modified, and all such variations are considered within the scope and spirit of the application. Accordingly, the protection sought herein is as set forth in the description.

Although the present embodiments are shown above, they are not limited to just these embodiments, but are amenable to various changes and modifications without departing from the spirit thereof.

The Use of Certain Words:

Polymer Material: Polymer material has the ability to return from a temporary deformed state to their permanent original shape when induced by external stimulus or force.

Airtight Structure: Airtight structures are structures that contain pressured and trapped air; the pressured and trapped air will push a deformed surface back to its original form upon impacted.

Sealing: Sealing can have several interpretations, in this invention, it is to the extent where liquids, dust and insects are preventing from passing from one side to the other.

Protruding and Aperture Shapes: Protruding and aperture shapes are engineered shapes that allows two respective and corresponding sections of a part to share a common space and save space. For example, rather than having the frame attached on top of the body consuming both the space of the frame and body, the frame it is attached to the body in a recessed position reducing the space of both parts.

Extending and Receding Edges: Extending and receding edges is also used to describe an engineering fitment, the edges intersect in respective and corresponding manner sealing the hollow mattress compartment. Extending and receding edges can be also designation as a male and female edge where the female edge is generally a receptacle that receives and holds the male edge.

Receding Structure: A resting position of two components with opposing aspects that intersect and cross at the opposing aspect. Receding structures are engineered positions where one component has a protruding aspect sitting in another component having a respective and corresponding aperture aspect.

Polyurethane, Latex, Memory or Hybrid Foam: Polyurethane, Latex, Memory or Hybrid Foam have a viscoelastic and low-resilience composition making it capable of compressing and reducing in size. The degree of its ability to reduce its size exceeds the variance of the slightly smaller hollow mattress size being slightly smaller than the combined folded mattress size that needs to shrink to fit upon folding.

It is claimed:

1. A bed system comprising a frame, a body and a mattress, wherein the body comprising a folding first side and a folding second side comprising a hollow mold structure comprising a polymer material, an interior aperture shape, an exterior aperture shape, an extending edge, a receding edge, a sealing membrane, a handle and a locking mechanism; the exterior aperture shape respective and corresponding to a protruding frame retaining the frame in a first recessed structure; the interior aperture shape respective and corresponding to a protruding mattress retaining the mattress in a second recessed structure; the interior aperture shape folding into a hollow mattress compartment; the extending edge respective and corresponding to the receding edge intersecting in a third recessed structure of the bed system in a folding configuration, the third recessed structure comprising a first seal, a secondary barrier and a second seal; the sealing membrane comprising a third seal on a side of the body that does not contain the extending and receding edges when the bed system is in the folding configuration; the body attaching to the frame with a first set of fasteners and attaching to the mattress with a second set of fasteners; the handle and locking mechanism having a portable function.

2. The bed system of claim 1 wherein the first seal, secondary barrier, second seal and third seal comprising an airtight structure preventing liquids, dust and insects from entering through the body into the mattress.

3. The bed system of claim 1 wherein the polymer material, hollow mold structure, hollow mattress compartment, and mattress retained in the hollow mattress compartment comprising an elastic and shock absorbing structure; the folding sides retaining the frame in a recessed structure preventing impact of the frame with an external object; the elastic and shock absorbing structure and preventing impact of the frame preventing damage from occurring to the bed system on impact with another object when in the folding configuration.

4. The bed system of claim 1 wherein the exterior aperture shape retaining the frame in the first recessed structure; the interior aperture shape forming the said hollow mattress compartment retaining the mattress in the second recessed structure; the hollow mattress compartment comprising a first dimension, the mattress comprising a second dimension in a folded configuration, the mattress comprising an excess mattress material extending over an edge of the bed system when in an unfolding configuration, the mattress second dimension exceeds the dimension of the hollow mattress compartment first dimension, the hollow mattress compartment compressing the mattress and excess mattress material forcing, fitting and sealing the mattress in the hollow mattress compartment when the bed system is in the folding configuration; the first and second recessed structures and compressed mattress having a reduced overall size of the bed system when in the folding configuration.

* * * * *